US010847079B2

(12) United States Patent
Tian

(10) Patent No.: US 10,847,079 B2
(45) Date of Patent: Nov. 24, 2020

(54) METHOD OF DRIVING DISPLAY PANEL AND DRIVING DEVICE

(71) Applicant: WUHAN CHINA STAR OPTOELECTRONICS TECHNOLOGY CO., LTD., Wuhan (CN)

(72) Inventor: Nian Tian, Shenzhen (CN)

( * ) Notice: Subject to any disclaimer, the term of this patent is extended or adjusted under 35 U.S.C. 154(b) by 0 days.

(21) Appl. No.: 16/607,108

(22) PCT Filed: May 27, 2017

(86) PCT No.: PCT/CN2017/086229

§ 371 (c)(1),
(2) Date: Oct. 22, 2019

(87) PCT Pub. No.: WO2018/196086

PCT Pub. Date: Nov. 1, 2018

(65) Prior Publication Data

US 2020/0135085 A1 Apr. 30, 2020

(30) Foreign Application Priority Data

Apr. 28, 2017 (CN) ..... 2017 1 0295392

(51) Int. Cl.
*G09G 3/20* (2006.01)

(52) U.S. Cl.
CPC ..... *G09G 3/2074* (2013.01); *G09G 3/2003* (2013.01); *G09G 2320/0233* (2013.01); *G09G 2320/0626* (2013.01); *G09G 2360/16* (2013.01)

(58) Field of Classification Search
None
See application file for complete search history.

(56) References Cited

U.S. PATENT DOCUMENTS 5,774,636 A * 6/1998 Sousa ..... G06K 15/00 358/1.18
10,147,390 B2 * 12/2018 Yang ..... G09G 3/2074
2004/0114046 A1 * 6/2004 Lee ..... H04N 9/67 348/279
2006/0269126 A1 * 11/2006 Lee ..... H04N 19/132 382/166
2008/0049048 A1 * 2/2008 Credelle ..... G09G 3/2074 345/690
2010/0296745 A1 * 11/2010 Strom ..... H04N 19/162 382/233
2013/0011059 A1 * 1/2013 Strom ..... H04N 19/14 382/166
2015/0117774 A1 * 4/2015 Yang ..... G06T 9/00 382/166
2018/0322832 A1 * 11/2018 Zhao ..... G09G 5/02

* cited by examiner

*Primary Examiner* — Patrick N Edouard
*Assistant Examiner* — Peijie Shen

(57) ABSTRACT

The present invention provides a method of driving a display panel and a driving device. The present invention determines sub-pixels shared by sub-pixel rendering technology through comparing differences of the color components, and the sub-pixels shared by the display image are not fixed. Since the sub-pixels with the smallest absolute value of the color component difference are selected for sharing, a contrast of an edge region of an image is improved, and distortion of an edge region of an image is reduced.

12 Claims, 5 Drawing Sheets

METHOD OF DRIVING DISPLAY PANEL AND DRIVING DEVICE

BACKGROUND OF INVENTION

Field of Invention

The present invention relates to the field of display, and in particular to a method of driving a display panel and a driving device.

Description of Prior Art

In order to increase arrangement density of sub-pixels of the display panel to improve resolution, sizes of the sub-pixels are getting smaller and smaller. However, sizes of the sub-pixels are restricted by factors such as a pixel aperture ratio and manufacturing processes, the sizes of the sub-pixels cannot be reduced indefinitely, which limits a further improvement of resolution. Currently, the industry can further improve the resolution of the display panel by sub-pixel rendering (SPR) technology, which realizes an improved sensory resolution by sharing sub-pixels by adjacent pixel units, and meanwhile sensory resolution of the display panel is increased under the same sub-pixel arrangement density. It can also be regarded as reducing demands on the sub-pixel arrangement density while maintaining the sensory resolution. However, the sub-pixels shared by the existing sub-pixel rendering technology are fixed, and when a color of an edge region of the image, such as the edges of texts or lines, changes rapidly, the existing sub-pixel rendering technology cannot accurately display a contrast of the edge region of the image, resulting in distortion in the edge region of the image.

SUMMARY OF INVENTION

In view of this, the present invention provides a method of driving a display panel and a driving device, which can improve a contrast of an edge region of an image and reduce distortion of an edge region of an image.

A method of driving a display panel according to an embodiment of the present invention is provided, wherein the display panel includes a plurality of identical pixel units arranged in a matrix, each of the pixel units comprises sub-pixels of three colors of red, green and blue in a row direction, and the method of driving a display panel comprises:

constituting a logical pixel by adjacent ones of the sub-pixels in the row direction, and dividing the pixel units in the row direction into a plurality of logical pixel groups, each of the logical pixel groups comprising a first logical pixel, a second logical pixel, and a third logical pixel arranged sequentially in the row direction, the second logical pixel lacking a predetermined color possessed by its adjacent sub-pixels;

obtaining color components of the predetermined colors in the first logical pixel, the second logical pixel, and the third logical pixel for image display;

calculating a first color component difference between the predetermined colors in the second logical pixel and the first logical pixel, and a second color component difference between the predetermined colors in the second logical pixel and the third logical pixel, and comparing absolute values of a first color component difference and a second color component difference;

determining luminous intensity of the sub-pixel of the predetermined color when the second logical pixel displays an image according to the color component of the predetermined color in the first logical pixel, if the absolute value of the first color component difference is less than or equal to the absolute value of a second color component difference; and determining luminous intensity of the sub-pixel of the predetermined color when the second logical pixel displays the image according to the color component of the predetermined color in the third logical pixel, if the absolute value of the first color component difference is greater than the absolute value of a second color component difference, wherein the luminous intensity of the sub-pixel of the predetermined color is determined according to a formula as follows:

$$L=N*(P_{2C2}+P_{mC2}),$$

where L is the luminous intensity of the sub-pixel of the predetermined color, N is a constant, $P_{2C2}$ is the color component of the predetermined color in the second logical pixel, and $P_{mC2}$ is the color component of the predetermined color in the first logical pixel or the third logical pixel.

A method of driving a display panel according to an embodiment of the present invention is provided, wherein the display panel comprises a plurality of identical pixel units arranged in a matrix, each of the pixel units comprises a plurality of sub-pixels of different colors in a predetermined direction, and the method of driving a display panel comprises:

constituting a logical pixel by adjacent ones of the sub-pixels in the row direction, and dividing the pixel units in the row direction into a plurality of logical pixel groups, each of the logical pixel groups comprising a first logical pixel, a second logical pixel, and a third logical pixel arranged sequentially in the row direction, the second logical pixel lacking a predetermined color possessed by its adjacent sub-pixels;

obtaining color components of the predetermined colors in the first logical pixel, the second logical pixel, and the third logical pixel for image display;

calculating a first color component difference between the predetermined colors in the second logical pixel and the first logical pixel, and a second color component difference between the predetermined colors in the second logical pixel and the third logical pixel, and comparing absolute values of a first color component difference and a second color component difference;

determining luminous intensity of the sub-pixel of the predetermined color when the second logical pixel displays an image according to the color component of the predetermined color in the first logical pixel, if the absolute value of the first color component difference is less than or equal to the absolute value of a second color component difference; and determining luminous intensity of the sub-pixel of the predetermined color when the second logical pixel displays the image according to the color component of the predetermined color in the third logical pixel, if the absolute value of the first color component difference is greater than the absolute value of a second color component difference.

A driving device for a display panel according to an embodiment of the present invention is provided, wherein the display panel comprises a plurality of identical pixel units arranged in a matrix, each of the pixel units comprises a plurality of sub-pixels of different colors in a predetermined direction, and the method of driving a display panel comprises:

a processor configured to constitute a logical pixel by adjacent ones of the sub-pixels in the row direction, and dividing the pixel units in the row direction into a plurality of logical pixel groups, each of the logical pixel groups comprising a first logical pixel, a second logical pixel, and a third logical pixel arranged sequentially in the row direction, the second logical pixel lacking a predetermined color possessed by its adjacent sub-pixels;

the processor further configured to acquire color components of the predetermined colors in the first logical pixel, the second logical pixel, and the third logical pixel for image display;

the processor further configured to calculate a first color component difference between the predetermined colors in the second logical pixel and the first logical pixel, and a second color component difference between the predetermined colors in the second logical pixel and the third logical pixel, and compare absolute values of a first color component difference and a second color component difference;

wherein if the absolute value of the first color component difference is less than or equal to the absolute value of a second color component difference, the processor determines luminous intensity of the sub-pixel of each the predetermined color when the second logical pixel displays an image according to the color component of the predetermined color in the first logical pixel; and if the absolute value of the first color component difference is greater than the absolute value of a second color component difference, the processor determines luminous intensity of the sub-pixel of each the predetermined color when the second logical pixel displays the image according to the color component of the predetermined color in the third logical pixel is determined; and a driver configured to drive the sub-pixel of the predetermined color to emit light of the luminous intensity determined by the processor when the second logical pixel displays.

Advantageous Effects: The present invention determines sub-pixels shared by sub-pixel rendering technology through comparing differences of the color components, and the sub-pixels shared by the display image are not fixed. Since the sub-pixels with the smallest absolute value of the color component difference are selected for sharing, a contrast of an edge region of an image is improved, and distortion of an edge region of an image is reduced.

DETAILED DESCRIPTION OF PREFERRED EMBODIMENTS

The technical solutions of the various exemplary embodiments provided by the present invention are clearly and completely described in the following with reference to the accompanying drawings. The following embodiments and their technical features can be combined with each other without conflict.

Figure 1:
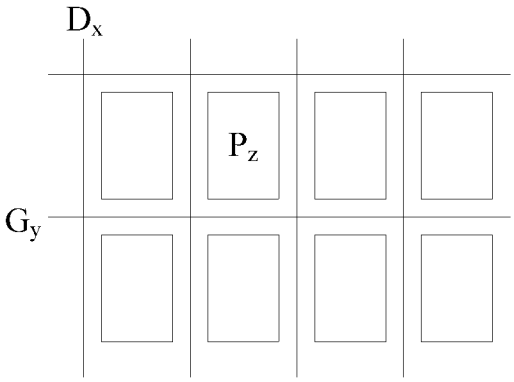
FIG. 1 is a schematic diagram of a pixel structure of a display panel according to an embodiment of the present invention.
Figure 3:
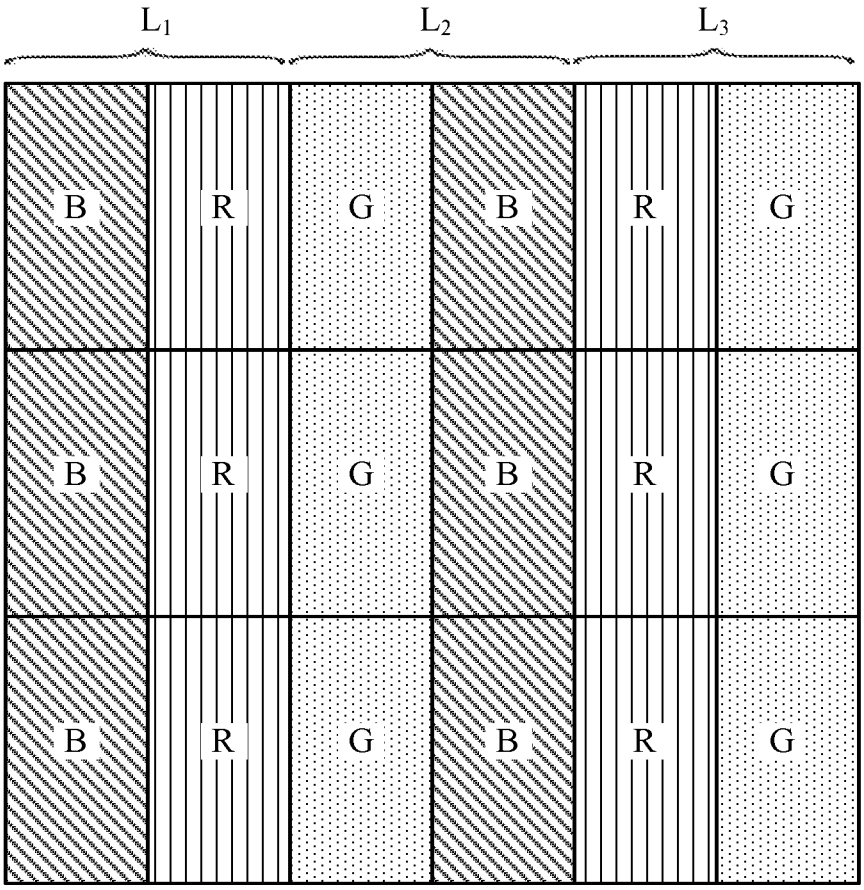
FIG. 3 is a schematic diagram showing an arrangement of sub-pixels of the display panel shown in FIG. 1.

Please refer to FIG. 1, which is a schematic diagram of a pixel structure of a display panel according to an embodiment of the present invention. The display panel includes a plurality of data lines Dx arranged in a column direction, a plurality of scanning lines Gy arranged in a row direction, and a plurality of pixel units Pz defined by the plurality of scanning lines Gy and the plurality of data lines Dx. These pixel units Pz may be arranged in a matrix and may be identical in structure and size. As shown in FIG. 3, in the row direction, each of the pixel units Pz may include three sub-pixels, which are a blue sub-pixel B, a red sub-pixel R, and a green sub-pixel G, respectively. Accordingly, the sub-pixels of the three colors are alternately arranged in the row direction, that is, a luminous color of any sub-pixel is different from luminous colors of the two adjacent sub-pixels in the row direction.

Figure 2:
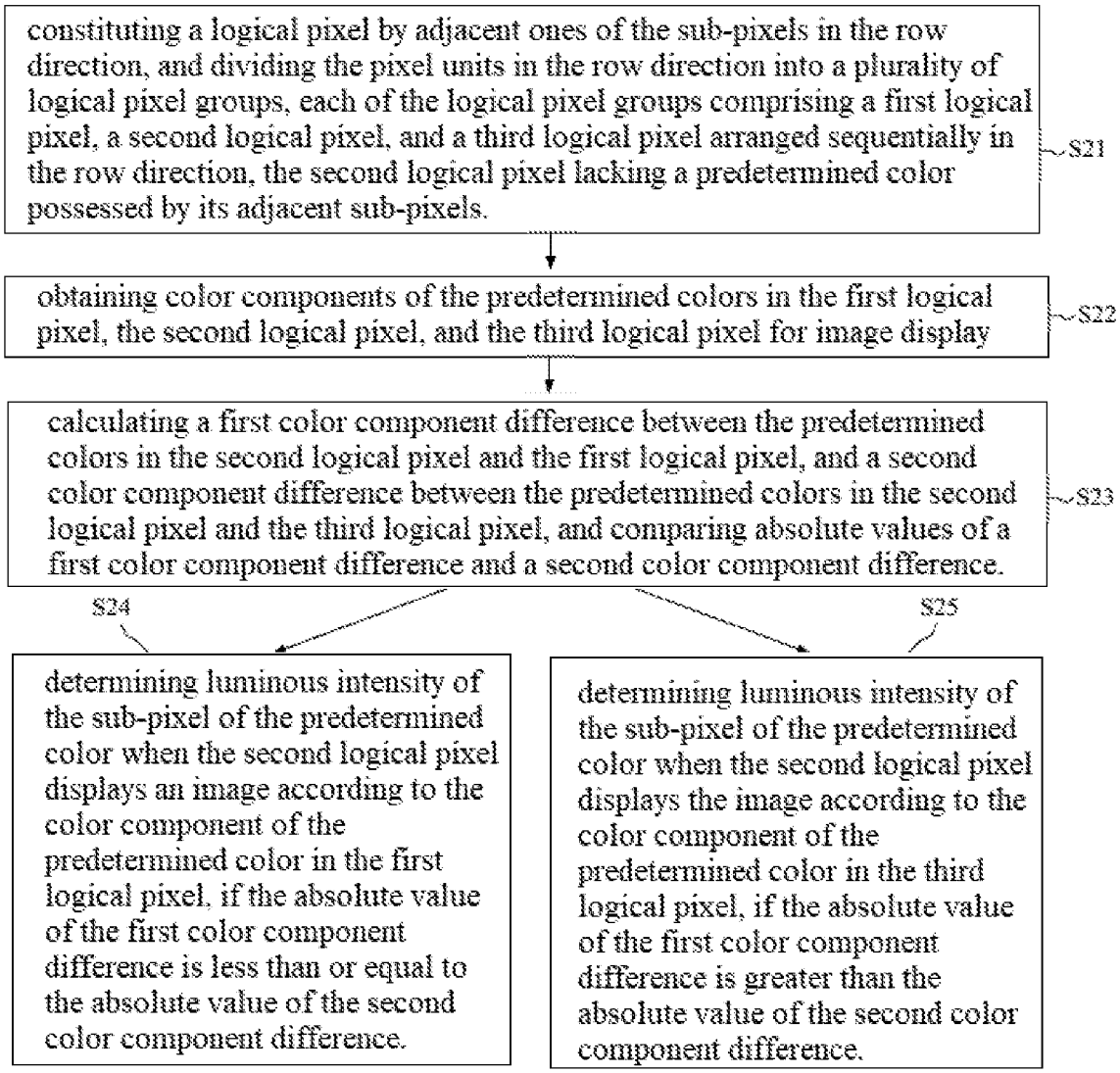
FIG. 2 is a schematic flow chart of a method of driving a display panel according to an embodiment of the present invention.

The driving method shown in FIG. 2 can drive the display panel. Referring to FIG. 2, a driving method according to an embodiment of the present invention may include steps S21 to S25.

S21: constituting a logical pixel by adjacent ones of the sub-pixels in the row direction, and dividing the pixel units in the row direction into a plurality of logical pixel groups, each of the logical pixel groups comprising a first logical pixel, a second logical pixel, and a third logical pixel arranged sequentially in the row direction, the second logical pixel lacking a predetermined color possessed by its adjacent sub-pixels.

In this embodiment, adjacent ones of the sub-pixels in the row direction may be selected to constitute a logical pixel. Taking the adjacent two pixel units Pz shown in FIG. 3 as an example, the blue sub-pixel B and the red sub-pixel R constitute a first logical pixel L1, the green sub-pixel G and the blue sub-pixel B constitute a second logical pixel L2, and the red sub-pixel R and the green sub-pixel G constitute a third logical pixel L3.

Each of the logical pixels includes only the sub-pixels of two color, and lacks sub-pixels of the colors included in its adjacent logical pixels. For example, the second logical pixel L2 lacks the red sub-pixel R included in the first logical pixel L1 and the third logical pixel L3.

S22: obtaining color components of the predetermined colors in the first logical pixel, the second logical pixel, and the third logical pixel for image display.

Figure 4:
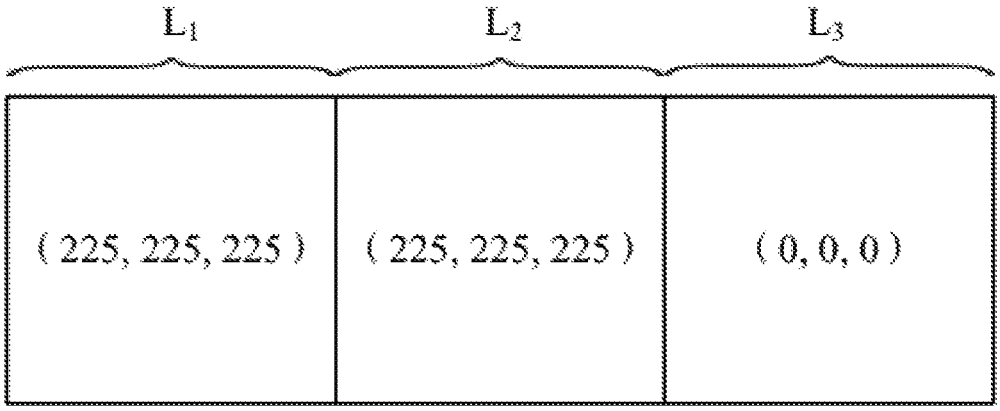
FIG. 4 is a schematic diagram showing color components of three adjacent logical pixels when the display panel shown in FIG. 1 displays an edge region of a first image.

For example, as shown in FIG. 4, when the display panel displays the edge region of the first image, the color components of red, green, and blue colors in the first logical pixel L1 are (225, 225, 225); the color components of red, green, and blue colors in the second logical pixel L2 are (225, 225, 225); and the color components of red, green, and blue colors in the third logical pixel L3 are (0, 0, 0).

Figure 5:
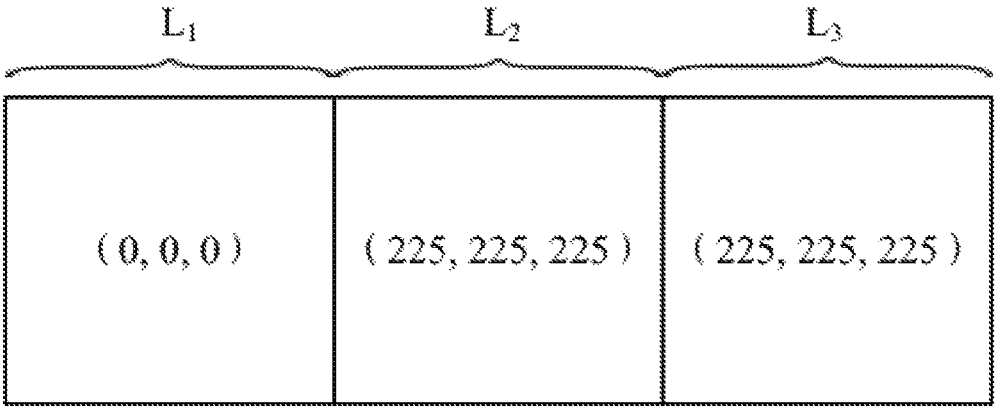
FIG. 5 is a schematic diagram showing color components of three adjacent logical pixels when the display panel shown in FIG. 1 displays an edge region of a second image.

For another example, as shown in FIG. 5, when the display panel displays the edge region of the second image, the color components of red, green, and blue colors in the first logical pixel L1 are (0, 0, 0); the color components of red, green, and blue colors in the second logical pixel L2 are (225, 225, 225); and the color components of red, green, and blue colors in the third logical pixel L3 are (225, 225, 225).

S23: calculating a first color component difference between the predetermined colors in the second logical pixel and the first logical pixel, and a second color component difference between the predetermined colors in the second logical pixel and the third logical pixel, and comparing absolute values of a first color component difference and a second color component difference.

Taking the red color as the predetermined color as an example, when the display panel displays the edge region of the first image as shown in FIG. 4, the red color component $P_{2C2}$ in the second logical pixel L2 is 225, and the red color component $P_{1C2}$ in the first logical pixel L1 is 225, and the red color component $P_{3C2}$ in the third logical pixel L3 is 0, a first color component difference $P_{2C2}-P_{1C2}$ is 0, a second color component difference $P_{3C2}-P_{2C2}$ is −225, and an absolute value of the first color component difference $|P_{2C2}-P_{1C2}|$ is 0, an absolute value of the second color component difference $|P_{3C2}-P_{2C2}|$ is 225.

When the display panel displays the edge region of the second image as shown in FIG. 5, the red color component $P_{2C2}$ in the second logical pixel L2 is 225, the red color component $P_{1C2}$ in the first logical pixel L1 is 0, and the red color component $P_{3C2}$ in the third logical pixel L3, a first color component difference $P_{2C2}-P_{1C2}$ is 225, a second color component difference $P_{3C2}-P_{2C2}$ is 0, and an absolute value of a first color component difference $|P_{2C2}-P_{1C2}|$ is 225 The absolute value of the second color component difference is $|P_{3C2}-P_{2C2}|$ is 0.

S24: determining luminous intensity of the sub-pixel of the predetermined color when the second logical pixel displays an image according to the color component of the predetermined color in the first logical pixel, if the absolute value of the first color component difference is less than or equal to the absolute value of the second color component difference.

When the display panel displays the edge region of the first image, since the absolute value of a first color component difference is smaller than the absolute value of a second color component difference, it will comply with $$|P_{2C2}-P_{1C2}|<|P_{3C2}-P_{2C2}|$$

In this embodiment, the luminous intensity of the red sub-pixel R when the second logical pixel L2 displays an image is determined according to the color component of the red color in the first logical pixel L1, that is, the luminous intensity of the red sub-pixel R when the second logical pixel L2 displays the edge region of the first image.

In this embodiment, the luminous intensity of the red sub-pixel R can be determined by the following formula:

$$L=N*(P_{2C2}+P_{mC2}) \quad \text{Formula I}$$

where L is the luminous intensity of the sub-pixel of the predetermined color, N is a constant, $P_{2C2}$ is the color component of the predetermined color in the second logical pixel, and $P_{mC2}$ is the color component of the predetermined color in the first logical pixel or the third logical pixel.

Figure 6:
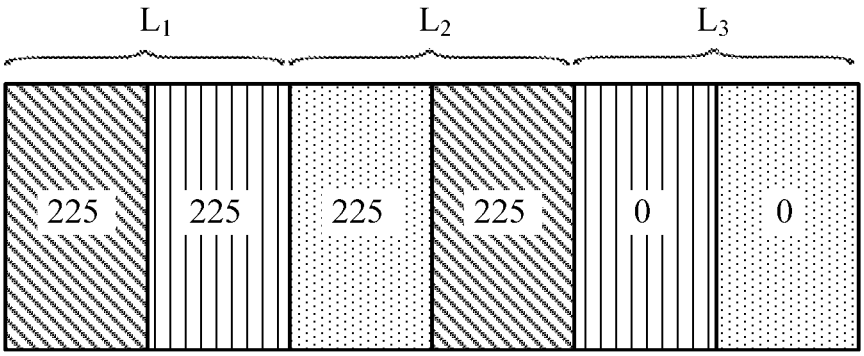
FIG. 6 is a schematic diagram showing color components of the respective sub-pixels when an edge region of a first image is displayed by the method of driving a display panel shown in FIG. 2.

When N is ½, the luminous intensity L of the red sub-pixel R obtained in this embodiment is 225, as shown in FIG. 6, but the red sub-pixel R of such a luminous intensity is located at a side of the second logical pixel L2 away from the third logical pixel L3. while at a side of the second logical pixel L2 adjacent to the third logical pixel L3, the luminous intensity of the red sub-pixel R is still 0, so that the contrast of the edge region of the first image can be accurately displayed, preventing the distortion in the edge region of the first image.

S25: determining luminous intensity of the sub-pixel of the predetermined color when the second logical pixel displays the image according to the color component of the predetermined color in the third logical pixel, if the absolute value of the first color component difference is greater than the absolute value of the second color component difference.

When the display panel displays the edge region of the second image, since the absolute value of a first color component difference is greater than the absolute value of a second color component difference, it will comply with $$|P_{2C2}-P_{1C2}|>|P_{3C2}-P_{2C2}|$$

In this embodiment, the luminous intensity of the red sub-pixel R when the second logical pixel L2 is displayed is determined according to the color component of red sub-pixel R in the third logical pixel L3.

Figure 7:
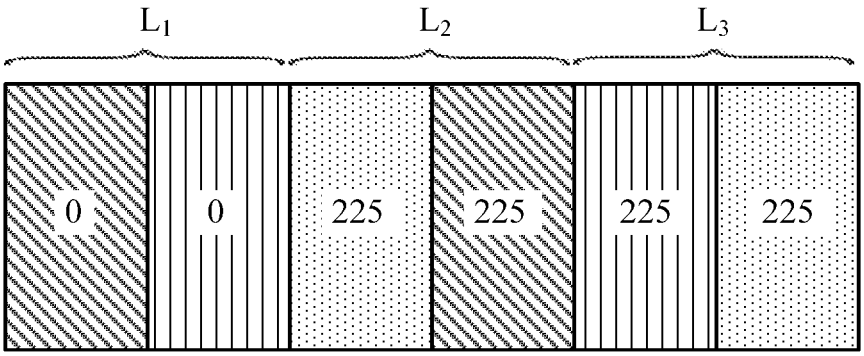
FIG. 7 is a schematic diagram showing color components of the respective sub-pixels when an edge region of a second image is displayed by the method of driving a display panel.

In this embodiment, the luminous intensity L of the red sub-pixel R is 225 according to the above formula I, as shown in FIG. 7, but the red sub-pixel R of such a luminous intensity is located at a side of the second logical pixel L2 away from the first logical pixel L1, while at a side of the second logical pixel L2 adjacent to the first logical pixel L1, the luminous intensity of the red sub-pixel R is still 0, so that the contrast of the edge region of the second image can be accurately displayed, preventing the distortion in the edge region of the second image.

Figure 8:
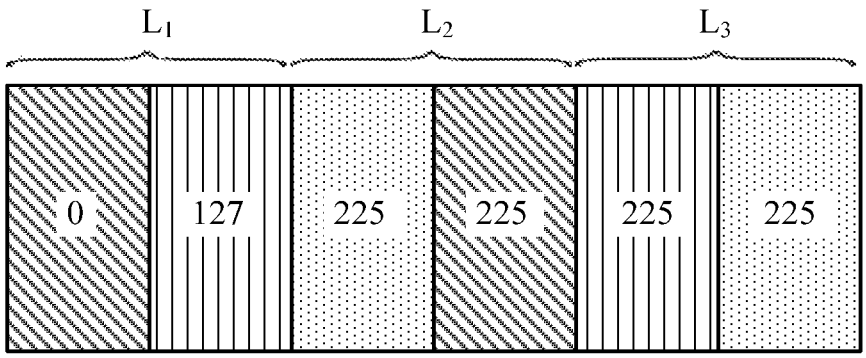
FIG. 8 is a schematic diagram showing color components of respective sub-pixels when an edge region of a second image is displayed by an existing sub-pixel rendering technique.

In a case of using the existing sub-pixel rendering technology to drive the display panel, if the red sub-pixel R of the first logical pixel L1 is fixedly selected as the shared sub-pixel of the second logical pixel L2, when the edge region of the first image is displayed, at the side of the second logical pixel L2 adjacent to the third logical pixel L3, the red sub-pixel R has an luminous intensity of 0, and as shown in FIG. 6, the contrast of the edge region of the first image can be accurately displayed to avoid distortion. However, when the edge region of the second image is displayed, the luminous intensity of the red sub-pixel R is 127 at the side of the second logical pixel L2 adjacent to the first logical pixel L1, as shown in FIG. 8, resulting in color aliasing in the edge region of the second image, such that contrast distortion occurs.

Figure 9:
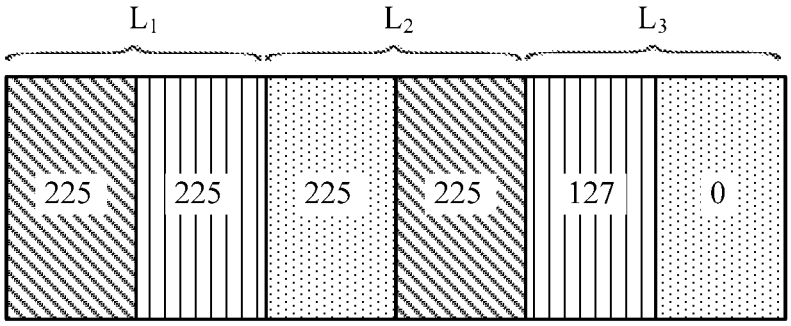
FIG. 9 is a schematic diagram showing color components of respective sub-pixels when an edge region of a first image is displayed by an existing sub-pixel rendering technique.

If the red sub-pixel R of the third logical pixel L3 is fixedly selected as the shared sub-pixel of the second logical pixel L2, when the edge region of the first image is displayed, at the side of the second logical pixel L2 adjacent to the third logical pixel L3, the red sub-pixel R has a luminous intensity of 127. As shown in FIG. 9, color aliasing occurs in the edge region of the second image, and contrast distortion occurs. When the edge region of the second image is displayed, on the side of the second logical pixel L2 adjacent to the first logical pixel L1, the luminous intensity of the red sub-pixel R is 0, as shown in FIG. 7, such that the edge region of the first image can be accurately displayed, and contrast distortion is avoided.

Therefore, the present invention determines sub-pixels shared by sub-pixel rendering technology through comparing differences of the color components, and the sub-pixels shared by the display image are not fixed. Since the sub-pixels with the smallest absolute value of the color component difference are selected for sharing, a contrast of an edge region of an image is improved, and distortion of an edge region of an image is reduced.

Figure 10:
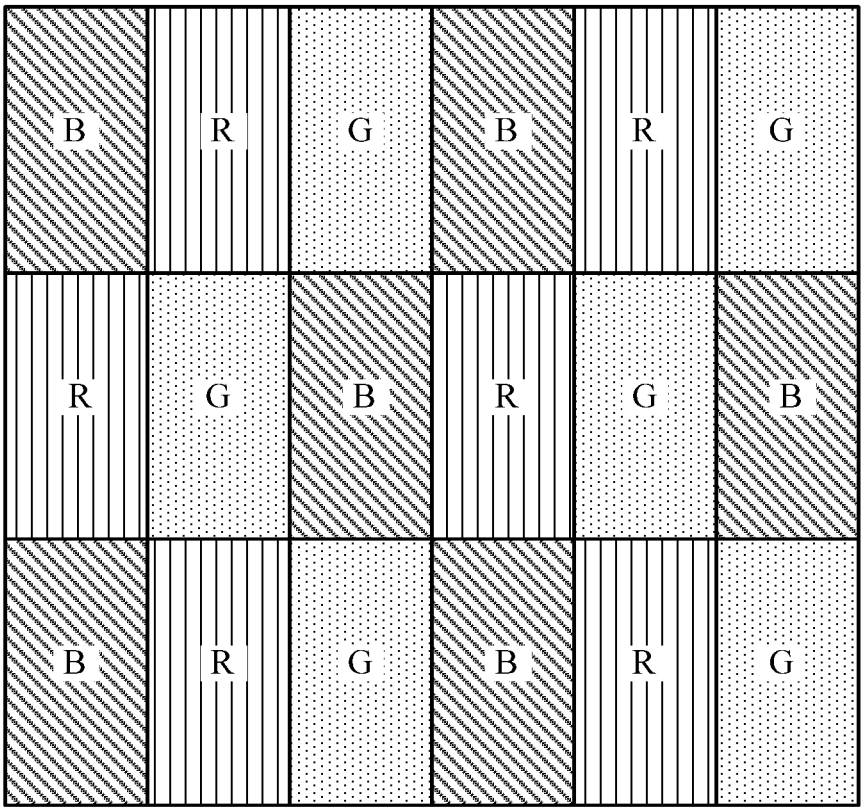
FIG. 10 is a schematic diagram of a pixel structure of a display panel according to another embodiment of the present invention.

The present invention is applicable not only to the display panel having a pixel structure of an RGB stripe type shown in FIG. 1, but also to the display panel having a pixel structure of an RGB delta type shown in FIG. 10. Referring to FIG. 10, the sub-pixels of the three colors (the blue sub-pixel B, the red sub-pixel R, and the green sub-pixel G) are also alternately arranged in the row direction. For the pixel structure of this embodiment, the present invention can still select adjacent ones of the sub-pixels in the column direction to constitute the first logical pixel L1, the second logical pixel L2, and the third logical pixel L3, respectively.

Figure 11:
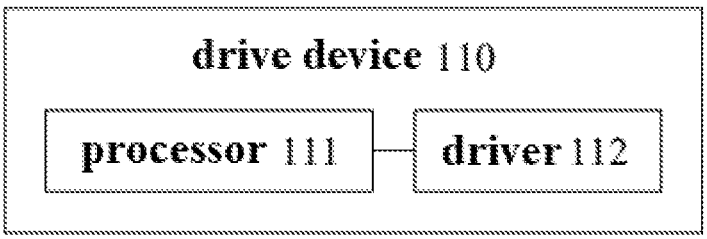
FIG. 11 is a schematic diagram showing a structure of a driving device for a display panel according to an embodiment of the present invention.

The present invention also provides a driving device for a display panel. As shown in FIG. 11, the drive device 110 includes a processor 111 and a driver 112 coupled to the processor 111.

The processor 111 is configured to constitute a logical pixel by adjacent ones of the sub-pixels in the row direction, and dividing the pixel units in the row direction into a plurality of logical pixel groups, each of the logical pixel groups comprising a first logical pixel, a second logical pixel, and a third logical pixel arranged sequentially in the row direction, the second logical pixel lacking a predetermined color possessed by its adjacent sub-pixels.

The processor 111 is further configured to acquire the color components of the predetermined colors in the first logical pixel, the second logical pixel, and the third logical pixel when the image is displayed.

The processor 111 is further configured to calculate a first color component difference between the predetermined colors in the second logical pixel and the first logical pixel, and a second color component difference between the predetermined colors in the second logical pixel and the third logical pixel, and compare absolute values of the first color component difference and the second color component difference.

If the absolute value of the first color component difference is less than or equal to the absolute value of the second color component difference, the processor 111 determines luminous intensity of the sub-pixel of each the predetermined color when the second logical pixel displays an image according to the color component of the predetermined color in the first logical pixel.

If the absolute value of the first color component difference is greater than the absolute value of the second color component difference, the processor 111 determines luminous intensity of the sub-pixel of each the predetermined color when the second logical pixel displays the image according to the color component of the predetermined color in the third logical pixel is determined.

The driver 112 is configured to drive the sub-pixel of the predetermined color to emit light of the luminous intensity determined by the processor 111 when the second logical pixel displays The structural elements of the driving device 110 of this embodiment correspond to the driving method of the above embodiments, and have the same technical effects.

While the invention has been described by way of example and in terms of the preferred embodiments, it is to be understood that the invention is not limited to the disclosed embodiments. To the contrary, it is intended to cover various modifications and similar arrangements. Therefore, the scope of the appended claims should be accorded the broadest interpretation so as to encompass all such modifications and similar arrangements.

What is claimed is:

1. A method of driving a display panel, wherein the display panel comprises a plurality of identical pixel units arranged in a matrix, each of the pixel units comprises sub-pixels of three colors of red, green and blue in a row direction, and the method of driving a display panel comprises:

constituting a logical pixel by adjacent ones of the sub-pixels in the row direction, and dividing the pixel units in the row direction into a plurality of logical pixel groups, each of the logical pixel groups comprising a first logical pixel, a second logical pixel, and a third logical pixel arranged sequentially in the row direction, the second logical pixel lacking a predetermined color possessed by its adjacent sub-pixels;

obtaining color components of the predetermined colors in the first logical pixel, the second logical pixel, and the third logical pixel for image display;

calculating a first color component difference between a color component of the predetermined color from an original image pixel corresponding to the second logical pixel and a color component of the predetermined color from the original image pixel corresponding to the first logical pixel, and a second color component difference between the predetermined colors in the second logical pixel and the third logical pixel, and comparing absolute values of the first color component difference and the second color component difference;

determining luminous intensity of the sub-pixel of the predetermined color when the second logical pixel displays an image according to the color component of the predetermined color in the first logical pixel, if the absolute value of the first color component difference is less than or equal to the absolute value of the second color component difference; and determining luminous intensity of the sub-pixel of the predetermined color when the second logical pixel displays the image according to the color component of the predetermined color in the third logical pixel, if the absolute value of the first color component difference is greater than the absolute value of the second color component difference, wherein the luminous intensity of the sub-pixel of the predetermined color is determined according to a formula as follows:

$$L=N*(P_{2C2}+P_{mC2}),$$

where L is the luminous intensity of the sub-pixel of the predetermined color, N is a constant, $P_{2C2}$ is the color component of the predetermined color in the second logical pixel, and $P_{mC2}$ is the color component of the predetermined color in the first logical pixel or the third logical pixel.

2. The method of driving a display panel according to claim 1, wherein N=1/2.

3. A method of driving a display panel, wherein the display panel comprises a plurality of identical pixel units arranged in a matrix, each of the pixel units comprises a plurality of sub-pixels of different colors in a predetermined direction, and the method of driving a display panel comprises:

constituting a logical pixel by adjacent ones of the sub-pixels in the row direction, and dividing the pixel units in the row direction into a plurality of logical pixel groups, each of the logical pixel groups comprising a first logical pixel, a second logical pixel, and a third logical pixel arranged sequentially in the row direction, the second logical pixel lacking a predetermined color possessed by its adjacent sub-pixels;

obtaining color components of the predetermined colors in the first logical pixel, the second logical pixel, and the third logical pixel for image display;

calculating a first color component difference between a color component of the predetermined color from an original image pixel corresponding to the second logical pixel and a color component of the predetermined color from the original image pixel corresponding to the first logical pixel, and a second color component difference between the predetermined colors in the second logical pixel and the third logical pixel, and comparing absolute values of the first color component difference and the second color component difference;

determining luminous intensity of the sub-pixel of the predetermined color when the second logical pixel displays an image according to the color component of the predetermined color in the first logical pixel, if the absolute value of the first color component difference is less than or equal to the absolute value of the second color component difference; and determining luminous intensity of the sub-pixel of the predetermined color when the second logical pixel displays the image according to the color component of the predetermined color in the third logical pixel, if the absolute value of the first color component difference is greater than the absolute value of the second color component difference.

4. The method of driving a display panel according to claim 3, wherein the predetermined direction comprises a row direction.

5. The method of driving a display panel according to claim 3, wherein each of the pixel units comprises the sub-pixels of three different colors, which are red, green, and blue, respectively $$L=N*(P_{2C2}+P_{mC2}),$$

6. The method of driving a display panel according to claim 3, wherein the luminous intensity of the sub-pixel of the predetermined color is determined according to a formula as follows:

$$L=N*(P_{2C2}+P_{mC2}),$$

where L is the luminous intensity of the sub-pixel of the predetermined color, N is a constant, $P_{2C2}$ is the color component of the predetermined color in the second logical pixel, and $P_{mC2}$ is the color component of the predetermined color in the first logical pixel or the third logical pixel.

7. The method of driving a display panel according to claim 6, wherein N=1/2.

8. A driving device for a display panel, wherein the display panel comprises a plurality of identical pixel units arranged in a matrix, each of the pixel units comprises a plurality of sub-pixels of different colors in a predetermined direction, and the method of driving a display panel comprises:

a processor configured to constitute a logical pixel by adjacent ones of the sub-pixels in the row direction, and dividing the pixel units in the row direction into a plurality of logical pixel groups, each of the logical pixel groups comprising a first logical pixel, a second logical pixel, and a third logical pixel arranged sequentially in the row direction, the second logical pixel lacking a predetermined color possessed by its adjacent sub-pixels;

the processor further configured to acquire color components of the predetermined colors in the first logical pixel, the second logical pixel, and the third logical pixel for image display;

the processor further configured to calculate a first color component difference between a color component of the predetermined color from an original image pixel corresponding to the second logical pixel and a color component of the predetermined color from the original image pixel corresponding to the first logical pixel, and a second color component difference between the predetermined colors in the second logical pixel and the third logical pixel, and compare absolute values of the first color component difference and the second color component difference;

wherein if the absolute value of the first color component difference is less than or equal to the absolute value of the second color component difference, the processor determines luminous intensity of the sub-pixel of each the predetermined color when the second logical pixel displays an image according to the color component of the predetermined color in the first logical pixel; and if the absolute value of the first color component difference is greater than the absolute value of the second color component difference, the processor determines luminous intensity of the sub-pixel of each the predetermined color when the second logical pixel displays the image according to the color component of the predetermined color in the third logical pixel is determined; and a driver configured to drive the sub-pixel of the predetermined color to emit light of the luminous intensity determined by the processor when the second logical pixel displays.

9. The driving device according to claim 8, wherein the predetermined direction comprises a row direction.

10. The driving apparatus according to claim 8, wherein each of the pixel units comprises sub-pixels of three different colors, which are red, green, and blue, respectively.

11. The driving apparatus according to claim 8, wherein the luminous intensity of the sub-pixel of the predetermined color is determined according to a formula as follows:

$$L=N*(P_{2C2}+P_{mC2}),$$

where L is the luminous intensity of the sub-pixel of the predetermined color, N is a constant, $P_{2C2}$ is the color component of the predetermined color in the second logical pixel, and $P_{mC2}$ is the color component of the predetermined color in the first logical pixel or the third logical pixel.

12. The driving device according to claim 11, wherein N=1/2.

* * * * *